US008766883B2

(12) United States Patent
Wacyk et al.

(10) Patent No.: US 8,766,883 B2
(45) Date of Patent: Jul. 1, 2014

(54) DUAL-MODE AMOLED PIXEL DRIVER, A SYSTEM USING A DUAL-MODE AMOLED PIXEL DRIVER, AND A METHOD OF OPERATING A DUAL-MODE AMOLED PIXEL DRIVER

(75) Inventors: Ihor Wacyk, Briarcliff Manor, NY (US); Olivier Prache, Hopewell Junction, NY (US)

(73) Assignee: eMagin Corporation, Hopewell Junction, NY (US)

( * ) Notice: Subject to any disclaimer, the term of this patent is extended or adjusted under 35 U.S.C. 154(b) by 619 days.

(21) Appl. No.: 12/859,571

(22) Filed: Aug. 19, 2010

(65) Prior Publication Data

US 2011/0074758 A1 Mar. 31, 2011

Related U.S. Application Data

(60) Provisional application No. 61/274,718, filed on Aug. 20, 2009.

(51) Int. Cl.
*G09G 3/30* (2006.01)
*G09G 3/32* (2006.01)

(52) U.S. Cl.
CPC ..... *G09G 3/3258* (2013.01); *G09G 3/3233* (2013.01); *G09G 2300/0842* (2013.01); *G09G 2300/0861* (2013.01); *G09G 2320/066* (2013.01); *G09G 2320/0223* (2013.01); *G09G 2330/10* (2013.01); *G09G 2330/04* (2013.01)
USPC ..... 345/76

(58) Field of Classification Search
CPC ..... G09G 3/3233; G09G 3/3258; G09G 2320/066
USPC ..... 345/76–83; 315/169.3
See application file for complete search history.

(56) References Cited

U.S. PATENT DOCUMENTS

2006/0108941 A1* 5/2006 Yang et al. ..... 315/209 R
2006/0202919 A1* 9/2006 Aoki et al. ..... 345/76

* cited by examiner

*Primary Examiner* — Dwayne Bost
*Assistant Examiner* — Christopher Kohlman
(74) *Attorney, Agent, or Firm* — Epstein Drangel LLP; Robert L. Epstein

(57) ABSTRACT

The present innovation provides a system for driving an OLED pixel that includes an arrangement for driving the OLED pixel in a voltage mode and an arrangement for driving the OLED pixel in a current mode. The system includes an arrangement for switching between the voltage mode and the current mode. When a selected luminance for the OLED pixel is high, the voltage mode may be selected by the switching arrangement, and when the selected luminance for the OLED pixel is low, the current mode may be selected by the switching arrangement. A driver circuit for an OLED pixel is provided. A method of driving an OLED pixel is provided that includes driving the OLED pixel in a voltage mode when a selected luminance for the OLED pixel is high. A computer-readable medium is provided having stored thereon computer-executable instructions that cause a processor to perform a method when executed.

20 Claims, 6 Drawing Sheets

DUAL-MODE AMOLED PIXEL DRIVER, A SYSTEM USING A DUAL-MODE AMOLED PIXEL DRIVER, AND A METHOD OF OPERATING A DUAL-MODE AMOLED PIXEL DRIVER

CROSS-REFERENCE TO RELATED APPLICATIONS

This application claims the benefit of U.S. Provisional Application No. 61/274,718 filed Aug. 20, 2009, which is incorporated herein by reference.

STATEMENT REGARDING FEDERALLY SPONSORED RESEARCH OR DEVELOPMENT

Not Applicable

BACKGROUND OF THE INVENTION

1. Field of the Invention

The present invention relates to organic light emitting devices (OLEDs). In particular, the present invention relates to a driver circuit for an OLED pixel that has a current mode and a voltage mode.

2. Description of Prior Art

An OLED device typically includes a stack of thin layers formed on a substrate. In the stack, a light-emitting layer of a luminescent organic solid, as well as adjacent semiconductor layers, are sandwiched between a cathode and an anode. The light-emitting layer may be selected from any of a multitude of fluorescent organic solids. Any of the layers, and particularly the light-emitting layer, also referred to herein as the emissive layer or the organic emissive layer, may consist of multiple sublayers.

In a typical OLED, either the cathode or the anode is transparent. The films may be formed by evaporation, spin casting or other appropriate polymer film-forming techniques, or chemical self-assembly. Thicknesses typically range from a few monolayers to about 1 to 2,000 angstroms. Protection of an OLED against oxygen and moisture can be achieved by encapsulation of the device. The encapsulation can be obtained by means of a single thin-film layer situated on the substrate, surrounding the OLED.

High resolution active matrix displays may include millions of pixels and sub-pixels that are individually addressed by the drive electronics. Each sub-pixel can have several semiconductor transistors and other IC components. Each OLED may correspond to a pixel or a sub-pixel, and therefore these terms are used interchangeably hereinafter.

In an OLED, one or more layers of semiconducting organic material may be sandwiched between two electrodes. An electric current is applied to the device, causing negatively charged electrons to move into the organic material(s) from the cathode. Positive charges, typically referred to as holes, move in from the anode. The positive and negative charges meet in the center layers (i.e., the semiconducting organic material), combine, and produce photons. The wave-length—and consequently the color—of the photons depends on the electronic properties of the organic material in which the photons are generated.

The color of light emitted from the organic light emitting device can be controlled by the selection of the organic material. White light may be produced by generating blue, red and green lights simultaneously. Specifically, the precisely color of light emitted by a particular structure can be controlled both by selection of the organic material, as well as by selection of dopants in the organic emissive layers.

Pixel driver circuits can be configured as either current sources or voltage sources to control the amount of light generated by the OLED diode in an active matrix display. AMOLED microdisplays may require low amounts of current to generate light, especially when using analog gray scale rendition techniques. OLEDs may be driven in current mode due to the linear dependence of luminance on operating current. For low light level applications, a typical OLED microdisplay pixel current may be in the range of 10's to 100's of picoamps. A long channel transistor may be used to generate the output current.

BRIEF SUMMARY OF THE INVENTION

A compact circuit that can fit in a microdisplay application may not accommodate the use of very long channel transistors. Operation of the microdisplay driver circuit in the subthreshold mode has been used in OLED microdisplays to overcome this limitation.

The present innovation lies in a new pixel architecture aimed at AMOLED microdisplays. In contrast to the typical pixel driver that operates as either a voltage source or a current source when driving an OLED diode, a dual-mode pixel driver automatically switches between voltage and current mode operation to achieve significantly improved performance and manufacturability compared to either alone. Specifically, this innovation provides the following benefits: 1) better dynamic range than either voltage or current drive; 2) better pixel-to-pixel uniformity than current drive; 3) better current-limiting for OLED shorts than voltage or current drive; and 4) significant immunity to parasitic leakage currents.

The present innovation may enable miniaturization of AMOLED microdisplays, consistent with minimum requirements for pixel-to-pixel uniformity, very high contrast ratios, and better yield due to improved tolerance to OLED faults. This innovation is also compatible with standard silicon processing, requiring no custom technology development. The idea may also be applicable to larger format displays that employ an active matrix OLED architecture. The benefit is a less expensive device with improved image quality that may be used for both large volume and professional applications.

The present innovation provides a system for driving an OLED pixel that includes an arrangement for driving the OLED pixel in a voltage mode and an arrangement for driving the OLED pixel in a current mode. The system further includes an arrangement for switching between the voltage mode and the current mode.

In the system, when a selected luminance for the OLED pixel is high, the voltage mode may be selected by the switching arrangement, and when the selected luminance for the OLED pixel is low, the current mode may be selected by the switching arrangement.

In the system, the arrangement for switching may switch from the voltage mode to the current mode when the selected luminance drops below approximately 2% of a maximum luminance. The arrangement for switching may switch from the current mode to the voltage mode when the selected luminance rises above approximately 2% of the maximum luminance.

In the system, the arrangement for switching may be controlled by 1) a first bias voltage applied to a first transistor situated between a voltage source and the OLED pixel, 2) a voltage output by the voltage source (the voltage source being at least partially controlled by a data source), and 3) a second bias voltage applied to a second transistor situated between the voltage source and ground.

When the voltage output reaches a sub-threshold when decreasing from a higher voltage, an impedance of the first transistor may increase causing the arrangement for switching to switch from the voltage mode to the current mode. When a current applied to the OLED pixel reaches a threshold when increasing from a lower current, an impedance of the first transistor may decrease causing the arrangement for switching to switch from the current mode to the voltage mode.

A driver circuit for an OLED pixel is provided that includes a voltage source for providing a voltage to the OLED pixel and a first transistor connected between the voltage source and the OLED pixel. The driver circuit may also include a second transistor connected between the voltage source and ground.

The driver circuit may also include an arrangement for applying a first bias voltage to the first transistor. The first transistor may provide low impedance to a first current flowing from the voltage source to the OLED pixel when a selected luminance for the OLED pixel is high. The first transistor may provide high impedance to the first current flowing when the selected luminance for the OLED pixel is low.

The driver circuit may also include an arrangement for applying a second bias voltage to the second transistor. The second transistor may provide high impedance to a second current flowing from the voltage source to ground when the selected luminance for the OLED pixel is high. The second transistor may provide low impedance to the second current when the selected luminance for the OLED pixel is low.

In the driver circuit, the first bias voltage and the second bias voltage may be selected to provide the low impedance to the first current at approximately 2% to 100% of a maximum luminance. The first and second bias may be selected to provide the high impedance to the first current at approximately 0% to 2% of the maximum luminance.

A method of driving an OLED pixel is provided that includes driving the OLED pixel in a voltage mode when a selected luminance for the OLED pixel is high. The voltage mode applies a voltage from a voltage supply across the OLED, and the voltage supply is at least partially controlled by a data signal indicating the selected luminance. The method further includes driving the OLED pixel in a current mode when the selected luminance for the OLED pixel is low. The current mode applies a current to the OLED from the voltage supply, and the current is at least partially controlled by a first transistor situated between the voltage supply and the OLED. The first transistor is at least partially controlled by a first bias voltage.

The method may further include providing a second transistor situated between the voltage supply and ground and parallel to the first transistor and the OLED. The second transistor may be at least partially controlled by a second bias voltage.

The method may further include selecting the first bias voltage and the second bias voltage. The first bias voltage and the second bias voltage may be selected to provide a low impedance to the voltage from the voltage supply applied across the OLED when the data signal indicates the selected luminance is approximately 2% to 100% of a maximum luminance. The first bias voltage and the second bias voltage may be selected to provide a high impedance to the voltage from the voltage supply applied across the OLED when the data signal indicates the selected luminance is approximately 0% to 2% of the maximum luminance.

The method may further include at least partially controlling the voltage supply with a third transistor. The third transistor may be at least partially controlled by the data signal.

A computer-readable medium is provided having stored thereon computer-executable instructions. The computer-executable instructions cause a processor to perform a method when executed. The method is for driving an organic light emitting diode (OLED) pixel.

DETAILED DESCRIPTION OF THE INVENTION

Scaling of the silicon process and reduction of pixel sizes makes it challenging to implement a current driven design due to area constraints, matching errors, and increased leakage currents. In a PMOS circuit providing a voltage driven mode to an OLED pixel, leakage currents to the voltage (e.g., VAN) supply may prevent the OLED device from fully turning off, resulting in a loss of contrast and an increase in electrical crosstalk.

Figure 1:
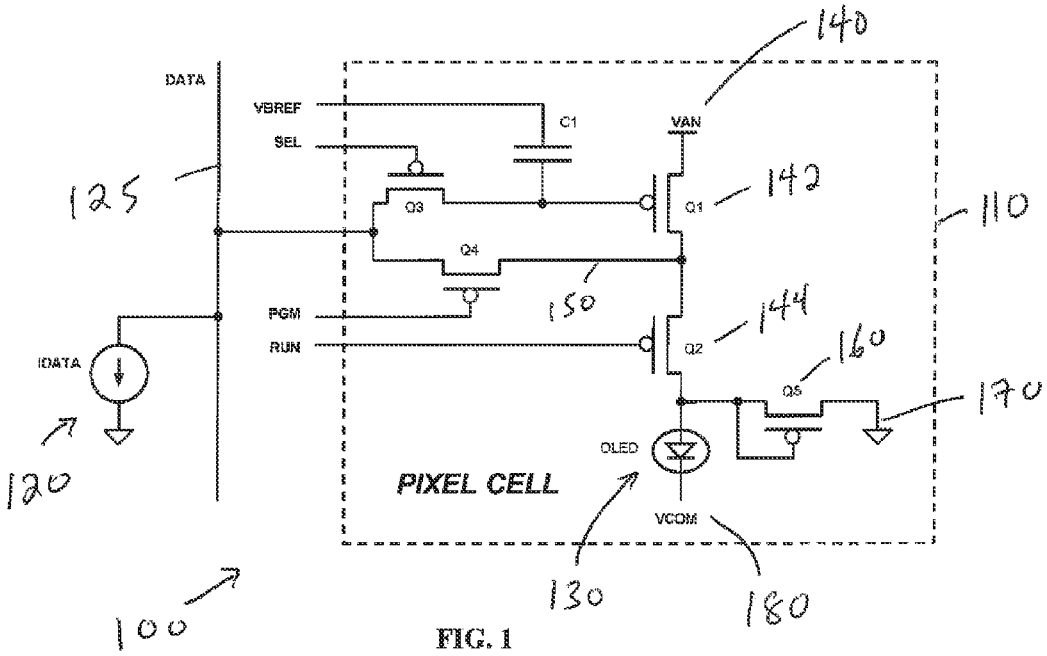
FIG. 1 is an exemplary current driven pixel circuit.

FIG. 1 illustrates pixel circuit 100. In pixel circuit 100, data signal 120 on data bus 125 is coupled to current driven pixel circuit 110. In current driven pixel circuit 110, VAN voltage supply 140 is modulated by the data from data bus 125 controlling Q1 transistor 142. The output of Q1 transistor 142 is coupled to data line 150 and input to Q2 transistor 144. The output of Q2 transistor 144 couples to OLED 130, which is coupled on an output side to VCOM voltage supply 180. Also coupled to an output of Q2 transistor 144 is Q5 transistor 160, which is coupled to ground 170. Current driven pixel circuit 110 operates in a current mode providing a current source to OLED 130, with the current being approximately linear to the desired luminance as indicated by the data of data signal 120.

When an OLED short occurs in current driven pixel circuit 110, a significant short-circuit current may flow from ground 170 to VCOM voltage source 180 via Q5 transistor 160. For example, a 1 kohm short in a single pixel may result in a constant leakage current of about 5 mA in the worst case. Even though a small number of OLED shorts may be allowed by the optical specifications (since they are hardly visible), a few such faults may quickly exceed the leakage current and power consumption limits defined in the electrical specification, resulting in a reduction in overall production yield.

Alternatively, OLEDs can be driven in the voltage mode which allows for the possibility of reduced pixel dimensions. In this approach the input signal modulates the voltage across the OLED diode, while the operating current of the OLED is determined by the OLED current-voltage (IV) characteristic. Voltage drive can deliver excellent control of OLED diodes in low-light applications using minimum size transistors with low matching errors. An NMOS switch used in source follower mode provides a basic implementation of a voltage source drive, as shown in FIG. 2.

Figure 2:
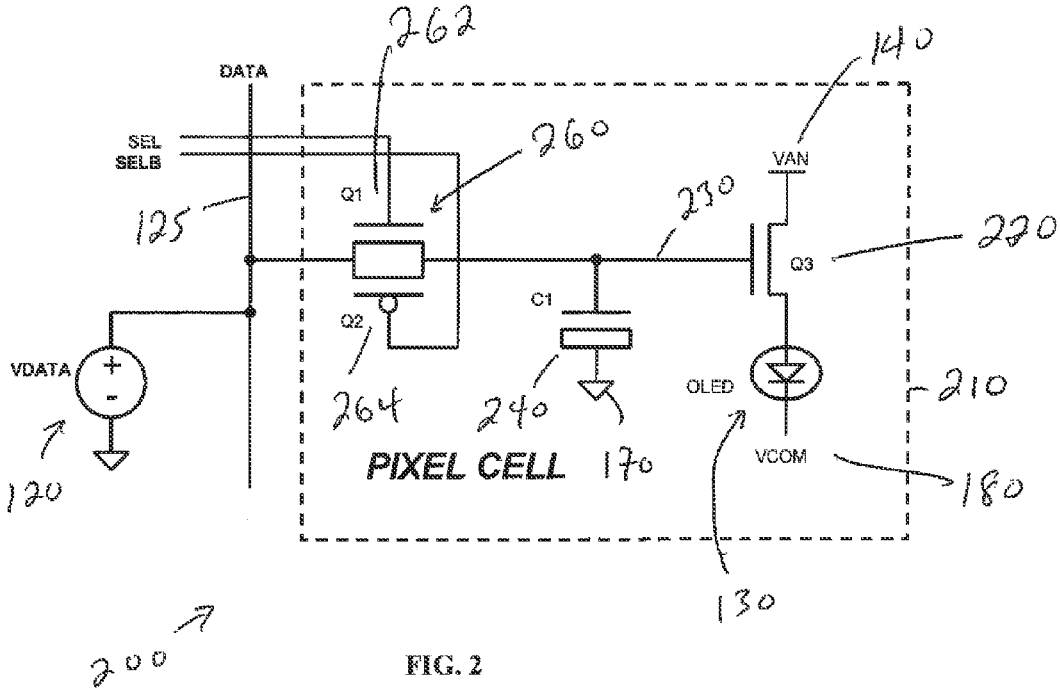
FIG. 2 is an exemplary voltage driven pixel circuit.

FIG. 2 illustrates pixel circuit 200 including an NMOS source follower implementation of a pixel voltage driver. In pixel circuit 200, data signal 120 on data bus 125 is coupled to voltage driven pixel circuit 210. In voltage driven pixel circuit 210, CMOS transmission gate 260, including Q1 transistor 262 and Q2 transistor 264, forms a data line access switch between data bus 125 and data line 230. Data line 230 controls Q3 transistor 220, and data line 230 is also coupled to capacitor 240, which leads to ground 170. VAN voltage supply 140 is modulated by Q3 transistor 220. The output of Q3 transistor 220 couples to OLED 130, which is coupled on an output side to VCOM voltage supply 180. Voltage driven pixel circuit 210 operates in a voltage mode providing a voltage source to OLED 130, with the voltage being approximately linear (at least at higher voltages/luminances) to the desired luminance, as indicated by the data of data signal 120.

A drawback of this approach is that it suffers from a significant body effect in a typical low-cost, N-well semiconductor. The body effect reduces the output swing of the driver, making it difficult to fully turn off OLED 130, thereby degrading the contrast ratio of the display. Additionally, when an OLED short occurs in voltage driven pixel circuit 210 of FIG. 2, a large current may flow between VAN voltage supply 140 and VCOM voltage supply 180 via Q3 transistor 220. For example, a 1 kohm short in a single pixel cell may cause a current of nearly 10 mA to flow when the gate of Q3 transistor 220 is biased at the maximum input signal. Even though a small number of OLED shorts may be allowed by the optical specifications, even a few such faults may quickly exceed the leakage current and power consumption limits in the electrical requirements, resulting in an excessive level of rejected parts during production.

As described above, further pixel miniaturization may result in either current mismatch in current mode or reduced dynamic range in voltage mode. Both modes also suffer from susceptibility to OLED shorts. The proposed innovation provides a solution to these problems.

Figure 3:
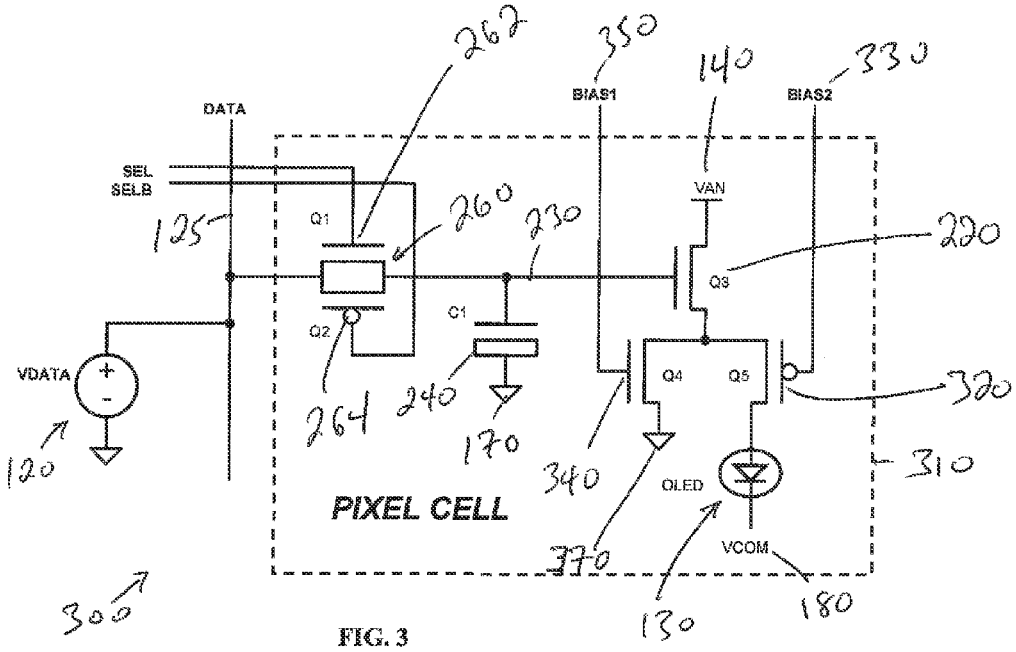
FIG. 3 is an exemplary dual-mode driven pixel circuit.

A schematic of pixel circuit 300 is shown in FIG. 3, which illustrates dual-mode driven pixel circuit 310. In pixel circuit 300, data signal 120 on data bus 125 is coupled to dual-mode driven pixel circuit 310. CMOS transmission gate 260, including Q1 transistor 262 and Q2 transistor 264, forms a data line access switch between data bus 125 and data line 230. Data line 230 controls Q3 transistor 220, and data line 230 is also coupled to capacitor 240, which leads to ground 170. In dual-mode driven pixel circuit 310, VAN voltage supply 140 is modulated by Q3 transistor 220, which is controlled by data line 230. The output of Q3 transistor 220 couples to Q5 transistor 320, which is controlled by bias current 330. The output of Q5 transistor 320 couples to OLED 130, which is coupled on an output side to VCOM voltage supply 180. The output of Q3 transistor 220 also couples to Q4 transistor 340, which is controlled by bias current 350. The output of Q4 transistor 340 couples to ground 370. Dual-mode driven pixel circuit 310 operates in a voltage mode at high luminance levels and in a current mode at low luminance levels.

Dual-mode driven pixel circuit 310 employs a combination of voltage and current drive modes implemented within a single drive circuit. Over most of the gray scale (also referred to herein as luminance or selected luminance), for example ranging from about 2% to 100% (where 100% represents a maximum luminance), OLED 130 may be driven in voltage mode, resulting in excellent low-level control and good matching between pixels. In this mode, the impedance of Q5 transistor 320 is negligible compared to that of OLED 130 and the drive is determined by Q3 transistor 220, as shown in FIG. 3. Because it operates as a unity gain voltage source, Q3 transistor 220 can be a minimum size transistor, allowing pixel miniaturization.

When the gray level drops below about 2% of full-scale, Q5 transistor 320, which may be a PMOS transistor, enters its sub-threshold region and its impedance rapidly exceeds that of OLED 130, resulting in current mode control of OLED 130 via Q5 transistor 320. In this mode, the current through OLED 130 can be reduced by 10 to 100 times below that of the voltage mode alone, achieving a very high contrast ratio for the display. Since the current control is only employed on the lowest gray levels (i.e., luminance levels), it is not particularly sensitive to mismatch error, allowing Q5 transistor 320 to be a relatively small device. The gray level at which the switch from voltage to current mode occurs is determined by the DC voltages of bias current 330 and bias current 350. Simultaneously, the voltage driver may be immune to leakage current from VAN voltage supply 140 via Q5 transistor 320 as long as the sink current provided by bias current 350 is greater than the leakage current.

When an OLED short occurs, Q5 transistor 320 acts as a current limiter. For example, a 1 kohm short will result in a worst-case current of only 50 microamps between VAN voltage supply 140 and VCOM voltage supply 180. Thus this innovation may reduce the leakage current for OLED shorts by 100 to 200 times compared to either of the standard current or voltage mode circuits, effectively eliminating this fault as a source of production yield loss.

In FIG. 3, CMOS transmission gate 260, consisting of Q1 transistor 262 and Q2 transistor 264, forms the data line access switch for dual-mode driven pixel circuit 310. Both switches are closed during the programming phase in order to write data into dual-mode driven pixel circuit 310 and both are opened at the end of the programming phase. During programming, capacitor 240 is charged to the level of data signal 120 and remains at that level after the programming phase ends. Q3 transistor 220, which may be an NMOS transistor, operates in the source follower mode, providing an output signal proportional to data signal 120 received at the source node of Q3 transistor 220. The network consisting of the parallel configuration of Q4 transistor 340, which may also be an NMOS transistor, and the series network formed by Q5 transistor 320 and OLED 130, serves as a load for the output of Q3 transistor 220. The combination of Q4 transistor 340 and Q5 transistor 320 acts as an analog switch that forces the drive function for OLED 130 to transition from voltage mode to current mode at a level of the input signal determined by the bias conditions supplied to the gates of Q4 transistor 340 and Q5 transistor 320, namely bias current 350 and bias current 330, respectively. With the appropriate gate bias settings, dual-mode driven pixel circuit 310 may function in voltage mode for approximately the upper 98% of the gray scale, and switch to current mode for the lowest part of the gray scale. Alternative switching points, and a reversal of the relative positions for the current and voltage modes, is also possible.

Dual-mode driven pixel circuit 310 may operate in the voltage mode of operation when data signal 120 corresponds to the upper gray scale (at high luminance levels). This situation arises when gate voltages on Q3 transistor 220 range from a level just greater than one NMOS threshold up to a level of VAN voltage supply 140. If Q4 transistor 340 is biased with a positive gate voltage of about one NMOS threshold, then it will operate in the saturation mode under these conditions, providing a relatively constant current load for Q3 transistor 220. At the same time, if the PMOS transistor Q5 transistor 320 is biased at about one PMOS threshold below ground, then it will be in its ohmic or linear region of operation. In this region its impedance will be negligible compared to OLED 130 and its influence can be excluded from consideration. As a result the anode of OLED 130 will track the output voltage of source follower Q3 transistor 220, which is approximately equal to the VDATA voltage minus about one NMOS threshold. The current in OLED 130 will be determined by its IV characteristic (i.e., current-voltage characteristic) in this mode of operation, and therefore it may be said to be voltage driven.

Dual-mode driven pixel circuit 310 may operate in the current mode of operation when data signal 120 corresponds to the lower gray scale (at low luminance levels). When the output voltage of Q3 transistor 220 approaches zero, Q5 transistor 320 enters the sub-threshold mode in which its drain current is exponentially dependent on its gate-to-source voltage. In this operating region, Q5 transistor 320 behaves like a current source that is controlled by the input signal (i.e., the output of Q3 transistor 220). As the input signal is reduced, the output current of Q5 transistor 320 drops rapidly and cuts off OLED 130. All load current from Q3 transistor 220 is steered away from Q5 transistor 320 and into Q4 transistor 340, allowing the OLED anode voltage to drop below ground level. The result is that the current in OLED 130 is reduced below that possible with a simple voltage drive scheme, achieving a high contrast under a wide range of operating conditions.

Figure 4:
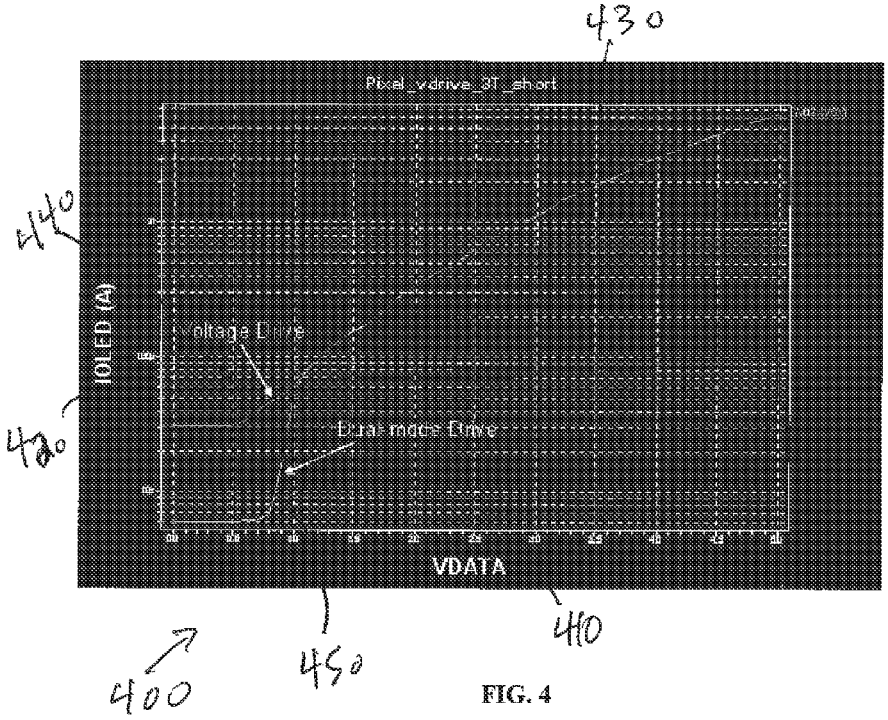
FIG. 4 illustrates exemplary current-voltage characteristics for a voltage driven pixel circuit and a dual-mode driven pixel circuit.

FIG. 4 shows the gamma characteristic for the dual-mode pixel cell in comparison to a standard voltage drive cell. FIG. 4 illustrates current-voltage characteristic 400 for a voltage driven pixel circuit and a dual-mode driven pixel circuit. X-axis 410 of current-voltage characteristic 400 is a voltage of a data signal for an OLED. Y-axis 420 of current-voltage characteristic 400 is a current through the OLED. Signal 430 represents the IV characteristic for both the voltage driven pixel circuit and the dual-mode driven pixel circuit at a high luminance value. At low luminance, signal 430 divides into two signals, low voltage signal 440 which represents the luminance of the voltage driven pixel circuit at low voltages, and current signal 450 which represents the luminance of the dual-mode driven pixel circuit at low voltages. Current signal 450 is substantially lower than low voltage signal 440, indicating a darker OLED and consequently better contrast in an OLED array.

Figure 5:
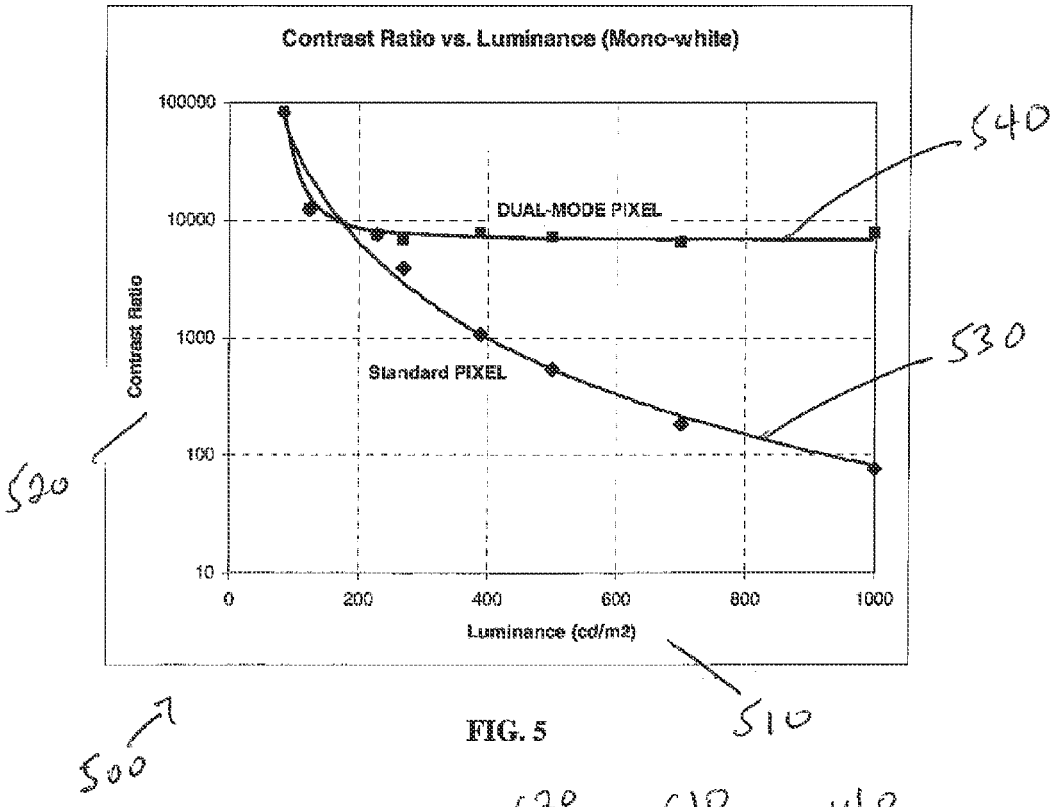
FIG. 5 illustrates exemplary contrast ratios for a voltage driven pixel circuit and a dual-mode driven pixel circuit.

FIG. 5 illustrates contrast ratio vs. luminance graph 500 for a standard voltage drive and a dual-mode drive. FIG. 5 shows that the dual-mode pixel design has improved contrast compared to a standard voltage mode pixel drive. X-axis 510 of contrast ratio vs. luminance graph 500 is a luminance output of an OLED. Y-axis 520 of contrast ratio vs. luminance graph 500 is a contrast ratio. Standard pixel contrast 530 from a standard voltage drive drops rapidly as the brightness level is increased. The OLED diode requires more voltage to supply the high luminance and this is limited by the fixed supply voltage. In contrast, dual-mode pixel contrast 540 provides a higher contrast because of the lower current it enables for low luminance situations.

Figure 6:
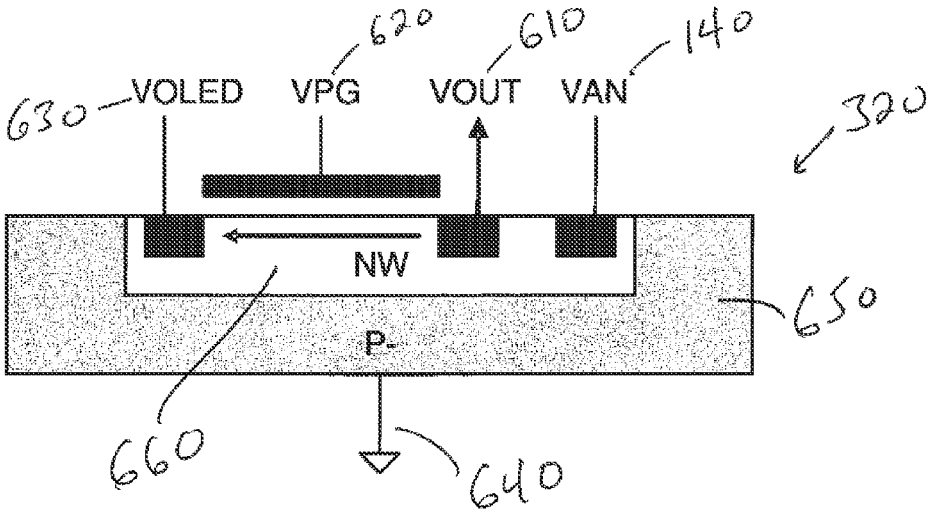
FIG. 6 is an exemplary cross-section of a transistor in a dual-mode driven pixel circuit.

FIG. 6 illustrates a cross-section of Q5 transistor 320, which in this case is a PMOS transistor. In the case of a highly ohmic OLED short (for instance, OLED resistance equal to 100 ohms), Q5 transistor 320 acts as a current limiter. The full VCOM voltage (i.e., VCOM voltage supply 180 in FIG. 3) is then dropped across Q5 transistor 320, so no current is allowed to flow in the silicon substrate. This depends on the P+ to N-well diode to sustain the negative voltage without breakdown. A typical low-voltage CMOS process will allow several volts of negative drop relative to P− substrate 650. VOLED 630 is the line to OLED 130, while VOUT 610 goes to Q3 transistor 220 in FIG. 3. VPG 620 is the voltage from bias current 330. Arrow 640 below P− substrate 650 leads to a ground connection. NW 660 is an N-doped Well region contained within P− substrate 650, and which contains the Q5 transistor 320, which is a p-type transistor.

Figure 7A:
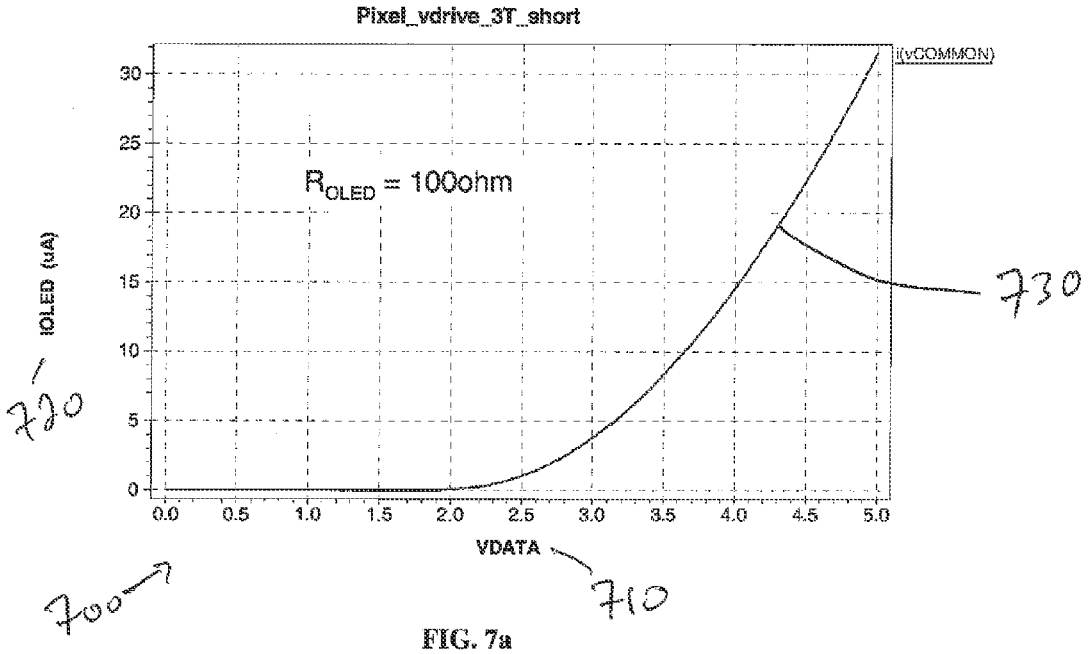
FIG. 7*a* illustrates an exemplary current-voltage characteristic for a shorted OLED pixel.

FIG. 7*a* illustrates shorted current-voltage graph 700 for a shorted OLED pixel. X-axis 710 of shorted current-voltage graph 700 is a voltage of a data signal for an OLED. Y-axis 720 of shorted current-voltage graph 700 is a current through the OLED. Shorted current-voltage characteristic (IV characteristic) 730 illustrates that, when the voltage of the data signal is high (i.e., when VOUT is high), Q5 transistor 320 allows some current (for example, 10's of uA) to flow through Q3 transistor 220, as shown in the simulation result given in FIG. 7*a*. No current flows in the substrate or to ground under these conditions. This is two orders of magnitude below the current level for a shorted OLED device in either the standard current or voltage driven methods. VOUT is the output of Q3 transistor 220. In this case, Q5 transistor 320 acts like a high-impedance resistor in series with the shorted OLED, so it limits the current following from Q3 transistor 220 to a few microamps.

Figure 7B:
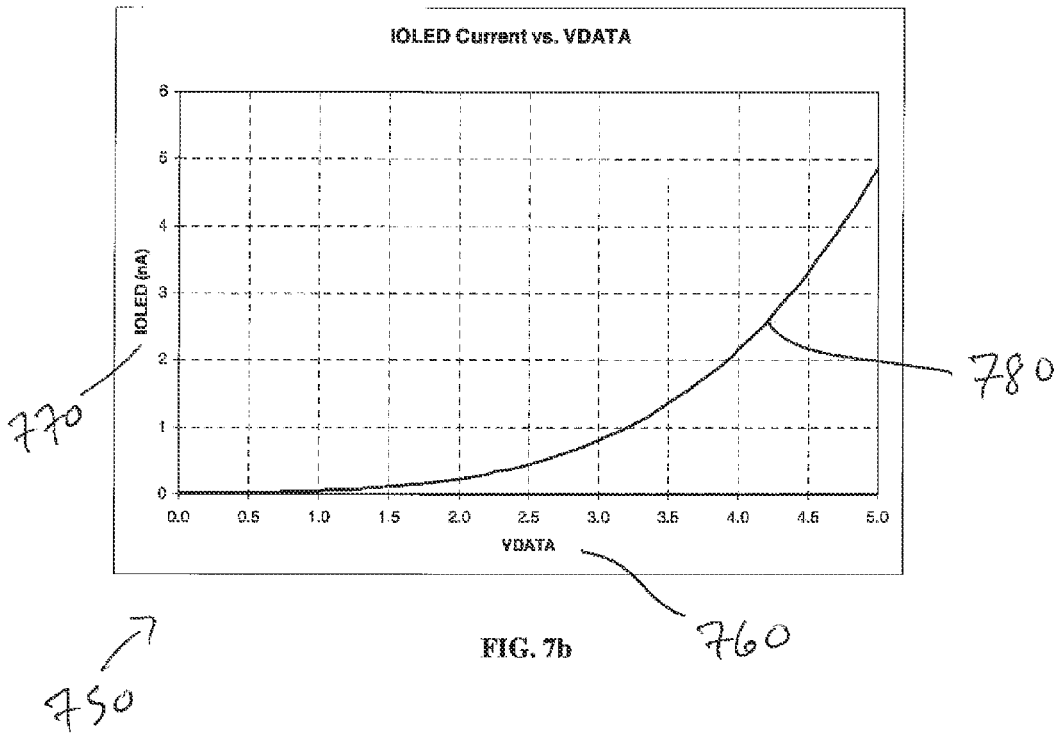
FIG. 7*b* illustrates an exemplary current-voltage characteristic for a functional OLED pixel.

FIG. 7*b* illustrates normal current-voltage graph 750 for a functional OLED pixel that is not shorted. X-axis 760 of normal current-voltage graph 750 is a voltage of a data signal for an OLED. Y-axis 770 of normal current-voltage graph 750 is a current through the OLED. Normal current-voltage characteristic (IV characteristic) 780 illustrates that the current flowing from Q3 transistor 220 is controlled since the OLED impedance, which may be greater than 1000 Mohms, is normally several orders of magnitude higher than Q5 transistor 320.

Figure 8:
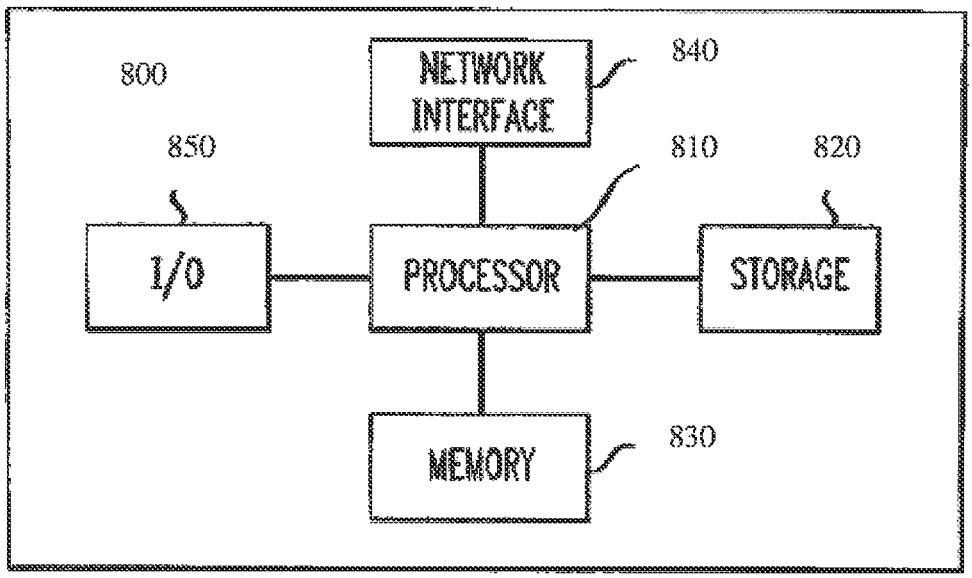
FIG. 8 illustrates a computer system according to an exemplary embodiment.

FIG. 8 illustrates a computer system according to an exemplary embodiment. Computer 800 can, for example, operate OLED drive circuit 110, 210, or 310, or may provide the data signal on data signal line 120. Additionally, computer 800 can perform the steps described above or below (e.g., with respect to FIG. 9). Computer 800 contains processor 810 which controls the operation of computer 800 by executing computer program instructions which define such operation, and which may be stored on a computer-readable recording medium. The computer program instructions may be stored in storage 820 (e.g., a magnetic disk, a database) and loaded into memory 830 when execution of the computer program instructions is desired. Thus, the computer operation will be defined by computer program instructions stored in memory 830 and/or storage 820 and computer 800 will be controlled by processor 810 executing the computer program instructions. Computer 800 also includes one or more network interfaces 840 for communicating with other devices, for example other computers, servers, or websites. Network interface 840 may, for example, be a local network, a wireless network, an intranet, or the Internet. Computer 800 also includes input/output 850, which represents devices which allow for user interaction with the computer 800 (e.g., display, keyboard, mouse, speakers, buttons, webcams, etc.). One skilled in the art will recognize that an implementation of an actual computer will contain other components as well, and that FIG. 8 is a high level representation of some of the components of such a computer for illustrative purposes.

Figure 9:
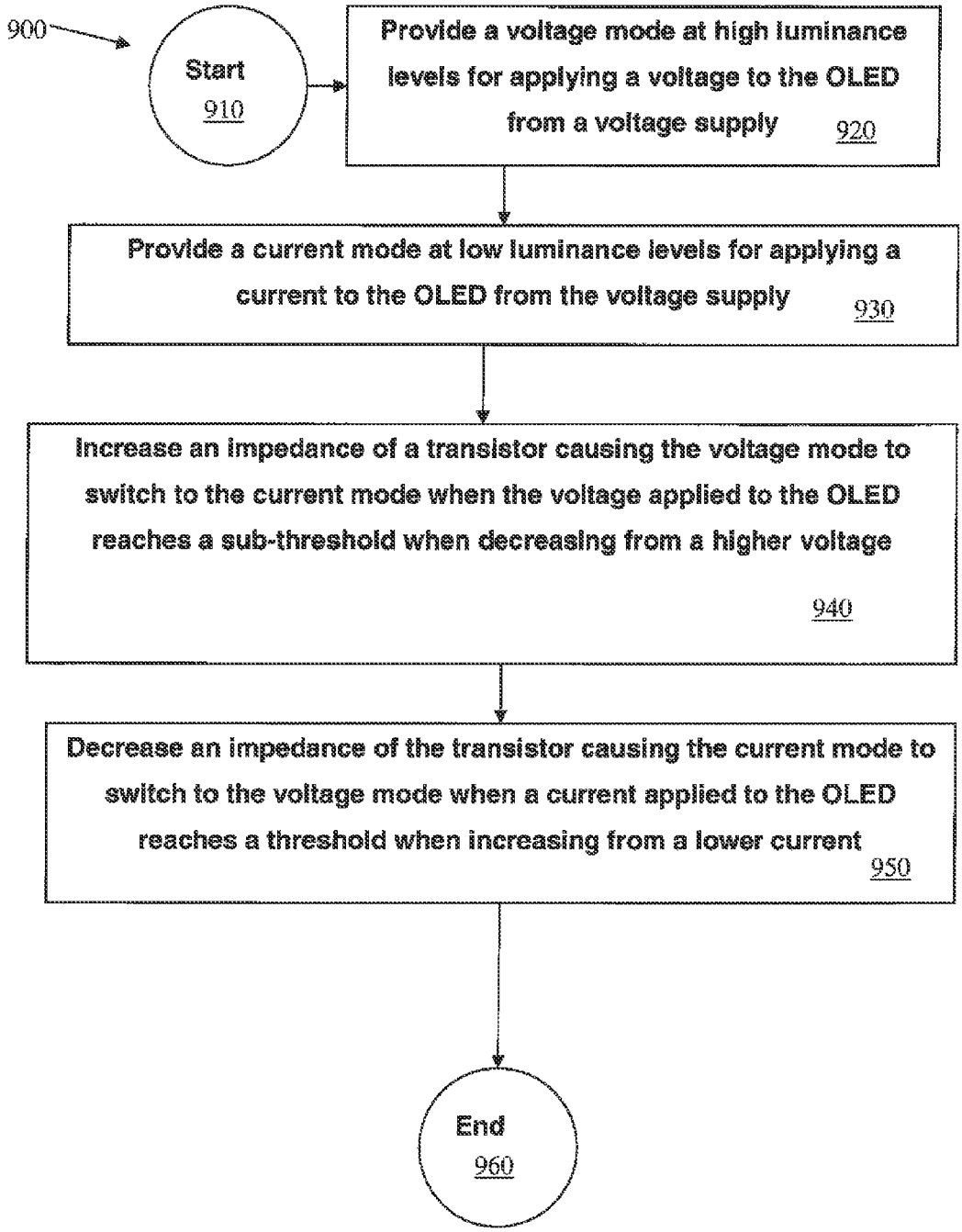
FIG. 9 illustrates a method according to an exemplary embodiment.

FIG. 9 illustrates method 900 according to an exemplary embodiment. Method 900 starts at start circle 910 and proceeds to operation 920, which indicates to provide a voltage mode at high luminance levels for applying a voltage to the OLED from a voltage supply. From operation 920 the flow in method 900 proceeds to operation 930, which indicates to provide a current mode at low luminance levels for applying a current to the OLED from the voltage supply. From operation 930 the flow in method 900 proceeds to operation 940, which indicates to increase an impedance of a transistor causing the voltage mode to switch to the current mode when the voltage applied to the OLED reaches a sub-threshold when decreasing from a higher voltage. From operation 940 the flow in method 900 proceeds to operation 950, which indicates to decrease an impedance of the transistor causing the current mode to switch to the voltage mode when a current applied to the OLED reaches a threshold when increasing from a lower current. From operation 950 the flow in method 900 proceeds to end circle 960.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

We claim:

1. A system for driving an OLED pixel, comprising:
means for driving the OLED pixel in a voltage mode;
means for driving the OLED pixel in a current mode; and
means for switching between the voltage mode and the current mode,
said switching means comprising first, second and third transistors, said first transistor being controlled by the data signal and having a output connected between a first voltage source and a node, said second transistor being controlled by a first bias current and having an output connected between said node and ground, said third transistor being controlled by a second bias current and having an output between said node and the OLED pixel.

2. The system of claim 1, wherein:
when a selected luminance for the OLED pixel is high, the voltage mode is selected by the switching means; and
when the selected luminance for the OLED pixel is low, the current mode is selected by the switching means.

3. The system of claim 2, wherein:
the means for switching switches from the voltage mode to the current mode when the selected luminance drops below approximately 2% of a maximum luminance; and
the means for switching switches from the current mode to the voltage mode when the selected luminance rises above approximately 2% of the maximum luminance.

4. A system for driving an OLED pixel, comprising:
means for driving the OLED pixel in a voltage mode;
means for driving the OLED pixel in a current mode; and
means for switching between the voltage mode and the current mode,
wherein the means for switching is controlled by:
a first bias voltage applied to a first transistor situated between a voltage source and the OLED pixel;
a voltage output by the voltage source, the voltage source being at least partially controlled by a data source; and
a second bias voltage applied to a second transistor situated between the voltage source and ground.

5. The system of claim 4, wherein when the voltage output reaches a threshold when decreasing from a higher voltage, an impedance of the first transistor increases causing the means for switching to switch from the voltage mode to the current mode.

6. The system of claim 4, wherein when the voltage output reaches a threshold when increasing from a lower voltage, an impedance of the first transistor decreases causing the means for switching to switch from the current mode to the voltage mode.

7. A driver circuit for an OLED pixel, comprising:
a data signal source;
a voltage source for providing a voltage to the OLED pixel;
a first transistor connected through a node between the voltage source and the OLED pixel; and
a second transistor connected between the voltage source and ground
said first transistor having an output connected between said node and ground, said second transistor having an output connected between said node and the OLED pixel, wherein said voltage source is connected to said node and provides voltage to said node in accordance with the signal from said data source.

8. A driver circuit for an OLED pixel, comprising:
a voltage source for providing a voltage to the OLED pixel;
a first transistor connected between the voltage source and the OLED pixel; and
a second transistor connected between the voltage source and ground,
further comprising means for applying a first bias voltage to the first transistor, the first transistor providing low impedance to a first current flowing from the voltage source to the OLED pixel when a selected luminance for the OLED pixel is high.

9. The driver circuit of claim 8, wherein the first transistor provides high impedance to the first current flowing when the selected luminance for the OLED pixel is low.

10. The driver circuit of claim 8, further comprising means for applying a second bias voltage to the second transistor, the second transistor providing high impedance to a second current flowing from the voltage source to ground when the selected luminance for the OLED pixel is high.

11. The driver circuit of claim 10, wherein the second transistor provides low impedance to the second current when the selected luminance for the OLED pixel is low.

12. The driver circuit of claim 10, wherein:
the first bias voltage and the second bias voltage are selected to provide the low impedance to the first current at approximately 2% to 100% of a maximum luminance; and
the first and second bias are selected to provide the high impedance to the first current at approximately 0% to 2% of the maximum luminance.

13. A method of driving an OLED pixel in either the voltage mode or the current mode using only a single driven pixel circuit, the OLED pixel circuit having a single scan line and a single data line connected thereto, comprising:
driving the OLED pixel in a voltage mode when a selected luminance for the OLED pixel high, the voltage mode for applying a voltage from a voltage supply across the OLED pixel, the voltage supply being at least partially controlled by a data signal on the single data line indicating the selected luminance; and
driving the OLED pixel in a current mode when the selected luminance for the OLED pixel is low, the current mode for applying a current to the OLED pixel from the voltage supply, the current being at least partially controlled by a first transistor situated between the voltage supply and the OLED pixel, the first transistor being at least partially controlled by a first bias voltage.

14. A method of driving an OLED pixel, comprising:

driving the OLED pixel in a voltage mode when a selected luminance for the OLED pixel is high, the voltage mode for applying a voltage from a voltage supply across the OLED pixel, the voltage supply being at least partially controlled by a data signal indicating the selected luminance; and driving the OLED pixel in a current mode when the selected luminance for the OLED pixel is low, the current mode for applying a current to the OLED pixel from the voltage supply, the current being at least partially controlled by a first transistor situated between the voltage supply and the OLED pixel, the first transistor being at least partially controlled by a first bias voltage, further comprising providing a second transistor situated between the voltage supply and ground and parallel to the first transistor and the OLED pixel, the second transistor being at least partially controlled by a second bias voltage.

15. The method of claim 14, further comprising:

selecting the first bias voltage; and selecting the second bias voltage;

wherein the first bias voltage and the second bias voltage are selected to provide a low impedance to the voltage from the voltage supply applied across the OLED pixel when the data signal indicates the selected luminance is approximately 2% to 100% of a maximum luminance; and wherein the first bias voltage and the second bias voltage are selected to provide a high impedance to the voltage from the voltage supply applied across the OLED pixel when the data signal indicates the selected luminance is approximately 0% to 2% of the maximum luminance.

16. A method of driving an OLED pixel, comprising:

driving the OLED pixel in a voltage mode when a selected luminance for the OLED pixel is high, the voltage mode for applying a voltage from a voltage supply across the OLED pixel, the voltage supply being at least partially controlled by a data signal indicating the selected luminance; and driving the OLED pixel in a current mode when the selected luminance for the OLED pixel is low, the current mode for applying a current to the OLED pixel from the voltage supply, the current being at least partially controlled by a first transistor situated between the voltage supply and the OLED pixel, the first transistor being at least partially controlled by a first bias voltage, further comprising the step of at least partially controlling the voltage supply with a third transistor, the third transistor being at least partially controlled by the data signal.

17. A non-transitory computer-readable medium having stored thereon computer-executable instructions, the computer-executable instructions causing a processor to perform a method when executed, the method for driving an organic light emitting diode (OLED) pixel, the method comprising:

selecting a first bias voltage for at least partially controlling a first transistor, the first transistor situated between a voltage supply and the OLED pixel and at least partially controlling a current applied to the OLED pixel from the voltage supply in a current mode;

selecting a second bias voltage for at least partially controlling a second transistor, the second transistor situated between the voltage supply and ground and parallel to the first transistor and the OLED pixel;

driving the OLED pixel in a voltage mode when a selected luminance for the OLED pixel is high, the voltage mode for applying a voltage from the voltage supply across the OLED pixel, the voltage supply being at least partially controlled by a data signal indicating the selected luminance; and driving the OLED pixel in the current mode when the selected luminance for the OLED pixel is low.

18. The computer-readable medium of claim 17, wherein the first bias voltage and the second bias voltage are selected to provide a low impedance to the voltage from the voltage supply applied across the OLED pixel when the data signal indicates the selected luminance is approximately 2% to 100% of a maximum luminance.

19. The computer-readable medium of claim 17, wherein the first bias voltage and the second bias voltage are selected to provide a high impedance to the voltage from the voltage supply applied across the OLED pixel when the data signal indicates the selected luminance is approximately 0% to 2% of the maximum luminance.

20. The computer-readable medium of claim 17, wherein the method further comprises at least partially controlling the voltage supply with a third transistor, the third transistor being at least partially controlled by the data signal.

* * * * *